US009091962B2

(12) United States Patent
Masui et al.

(10) Patent No.: US 9,091,962 B2
(45) Date of Patent: Jul. 28, 2015

(54) CARTRIDGE, DEVELOPING CARTRIDGE, PROCESS CARTRIDGE AND IMAGE FORMING APPARATUS

(71) Applicant: CANON KABUSHIKI KAISHA, Tokyo (JP)

(72) Inventors: Koichiro Masui, Numazu (JP); Masataka Mochizuki, Mishima (JP); Kenta Shibukawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/283,325

(22) Filed: May 21, 2014

(65) Prior Publication Data

US 2014/0348518 A1 Nov. 27, 2014

(30) Foreign Application Priority Data

May 23, 2013 (JP) ..... 2013-108521

(51) Int. Cl.
*G03G 15/08* (2006.01)

(52) U.S. Cl.
CPC ..... *G03G 15/0881* (2013.01); *G03G 15/0882* (2013.01)

(58) Field of Classification Search
CPC ..... G03G 15/0881; G03G 15/0882
See application file for complete search history.

(56) References Cited

U.S. PATENT DOCUMENTS

| | | | | |
|---|---|---|---|---|
| 6,122,458 | A * | 9/2000 | Kita et al. | 399/27 |
| 6,178,302 | B1 * | 1/2001 | Nagashima et al. | 399/106 |
| 6,804,476 | B2 | 10/2004 | Yokoi et al. | |
| 2001/0030015 | A1 * | 10/2001 | Chadani et al. | 156/189 |
| 2002/0012546 | A1 * | 1/2002 | Chanadi | 399/106 |
| 2010/0221028 | A1 * | 9/2010 | Kihara et al. | 399/53 |

FOREIGN PATENT DOCUMENTS

JP 2005-189528 A 7/2005

* cited by examiner

*Primary Examiner* — Sandra Brase
(74) *Attorney, Agent, or Firm* — Fitzpatrick, Cella, Harper & Scinto

(57) ABSTRACT

A cartridge includes: a developer accommodating chamber, provided with an opening, for accommodating a developer; a sealing member, provided with an electroconductive portion, for sealing the opening; and a storing element, provided with an electrical contact at a surface thereof, for storing information on the cartridge. The electroconductive portion covers the electrical contact.

12 Claims, 4 Drawing Sheets

CARTRIDGE, DEVELOPING CARTRIDGE, PROCESS CARTRIDGE AND IMAGE FORMING APPARATUS

FIELD OF THE INVENTION AND RELATED ART

The present invention relates to an image forming apparatus, of an electrophotographic type, such as a copying machine, a printer or a facsimile machine, and relates to a cartridge, a developing cartridge and a process cartridge which are usable in the image forming apparatus.

In the image forming apparatus such as the copying machine, the printer or the facsimile machine, an electrostatic latent image formed on a surface of a photosensitive drum as an image bearing member such as an electrophotographic photosensitive member or an electrostatic recording dielectric member has been visualized by using a developer (toner) in the form of powder.

In recent years, the efforts toward achieving environmental protection have been made actively, and as a part thereof, reductions of the number of parts (components) and size and the like are made. For that reason, it has been desired that a performance comparable to or more than a conventional performance is satisfied by a constitution simpler than a conventional constitution.

For example, Japanese Laid-Open Patent Application (JP-A) 2005-189528 has proposed a constitution in which communication of a non-contact memory, provided on a process cartridge, with an image forming apparatus is inhibited by using a seal member sealing a toner. In the constitution of JP-A 2005-189528, the non-contact memory is provided on the process cartridge, and a communication inhibiting member for inhibiting non-contact communication between the non-contact memory and a memory communication portion provided in the image forming apparatus.

The communication inhibiting member is connected with the seal member sealing the toner. Therefore, in the case where the seal member is removed, also the communication inhibiting member is removed, so that the communication can be established between the non-contact memory and the memory communication portion of the image forming apparatus. As a result, when the communication between the non-contact memory and the image forming apparatus is normally established, it is possible to detect that the seal member is removed.

On the other hand, in the case where the seal member is not removed, the communication inhibiting member is present between the non-contact memory and the memory communication portion of the image forming apparatus, and therefore the non-contact memory and the image forming apparatus cannot communicate with each other. Accordingly, in the case where the communication cannot be established between the non-contact memory and the image forming apparatus, it is possible to detect that the seal member is not removed. In this method, a result of enabling or disabling of the communication of the image forming apparatus with the non-contact memory also functions as detection of removal of the seal member sealing the toner.

In the constitution of JP-A 2005-189528, whether or not the seal member is removed was detected depending on the result of enabling or disabling of the communication between the non-contact memory and the memory communication portion of the image forming apparatus. However, JP-A 2005-189528 was silent about a specific constitution applicable to also a contact memory.

SUMMARY OF THE INVENTION

The present invention has solved the above-described problem, and a principal object of the present invention is to provide a cartridge capable of realizing, with a simple constitution, detection as to whether or not a sealing member which seals an opening of a developer accommodating chamber and capable of being applied to also a storing element for establishing communication of a contact type.

According to an aspect of the present invention, there is provided a cartridge comprising: a developer accommodating chamber, provided with an opening, for accommodating a developer; a sealing member, provided with an electroconductive portion, for sealing the opening; and a storing element, provided with an electrical contact at a surface thereof, for storing information on the cartridge, wherein the electroconductive portion covers the electrical contact.

These and other objects, features and advantages of the present invention will become more apparent upon a consideration of the following description of the preferred embodiments of the present invention taken in conjunction with the accompanying drawings.

DESCRIPTION OF THE EMBODIMENTS

An embodiment of a cartridge, a developing cartridge, a process cartridge and an image forming apparatus according to the present invention will be specifically described.

Incidentally, dimensions, materials, shapes and relative arrangement of constituent elements described in the following embodiments do not limit the scope of the present invention thereto unless otherwise specified.

<Image Forming Apparatus>

Figure 1:
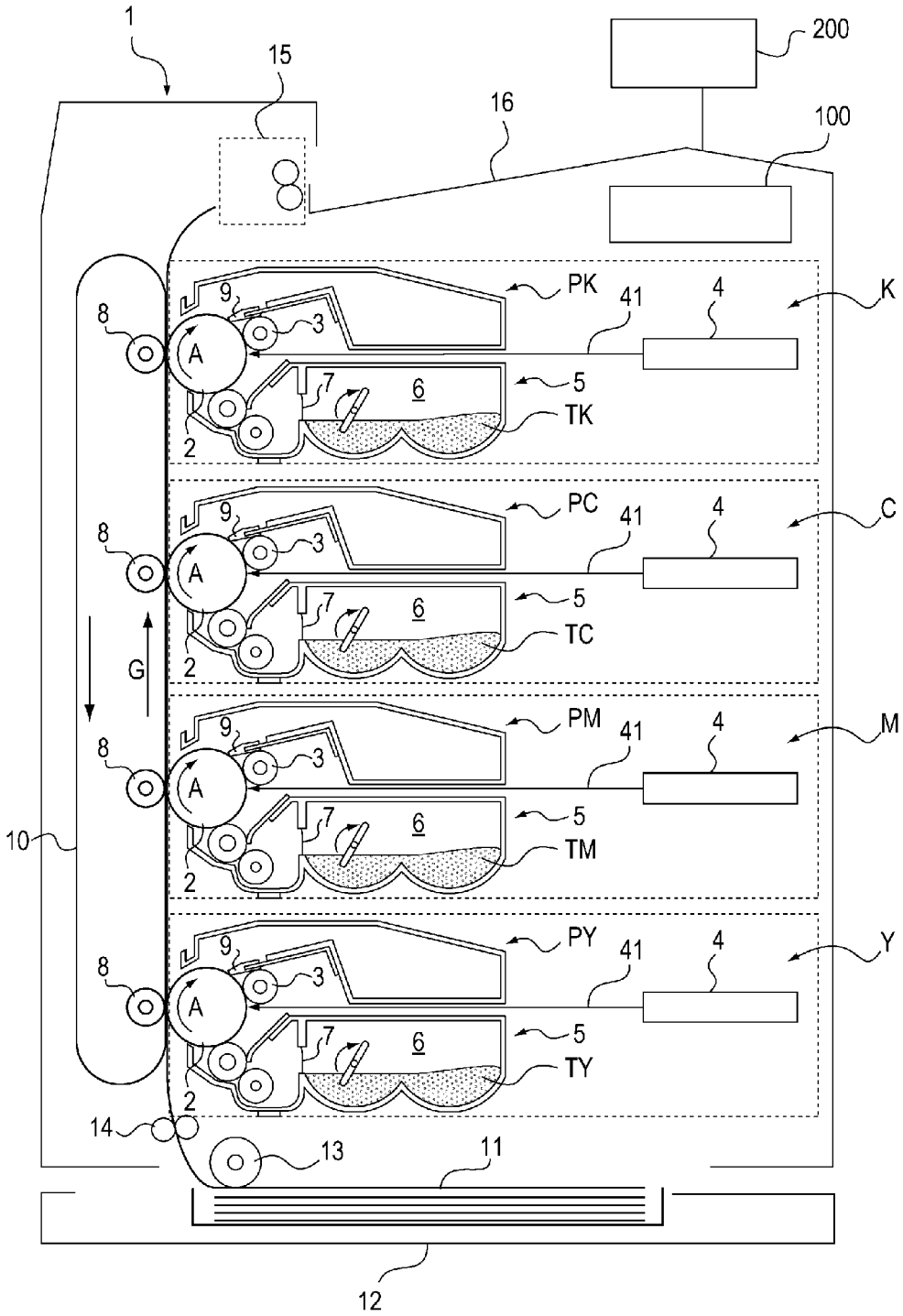
FIG. 1 is a sectional illustration showing a structure of an image forming apparatus including a cartridge according to the present invention.

FIG. 1 is a sectional illustration showing a structure of an image forming apparatus 1 for forming an image on a recording material 11 by using a non-magnetic one-component toner as a developer in this embodiment. This image forming apparatus 1 is a four-color based full-color image forming apparatus (multi-color image forming apparatus) which uses an electrophotographic process and which has a vertical tandem constitution (in-line constitution).

In FIG. 1, image forming stations Y, M and K are four image forming stations, which are provided in parallel from below to above in the listed order (i.e., the vertical tandem constitution) in a main assembly of the image forming apparatus 1, for forming toner images of colors of yellow, magenta, cyan and black, respectively.

The image forming stations, Y, M, C and K are constituted by the same electrophotographic process mechanism except that the colors of the toner images to be formed are different from each other. That is, each of the image forming stations Y, M, C and K includes a drum-type electrophotographic photosensitive member (photosensitive drum) 2 as an image bearing member on which the developer image is to be formed by an associated developer, and includes a charging roller 3 as a charging device for electrically charging the surface of the photosensitive drum 2 uniformly in contact with the surface of the photosensitive drum 2.

Further, each image forming station includes a laser scanner 4 as an exposure device for forming an electrostatic latent image by irradiating the charged surface of the photosensitive drum 2 with laser light 41 depending on image information, and includes a developing device 5 for developing the electrostatic latent image with a toner T as the developer.

Figure 2:
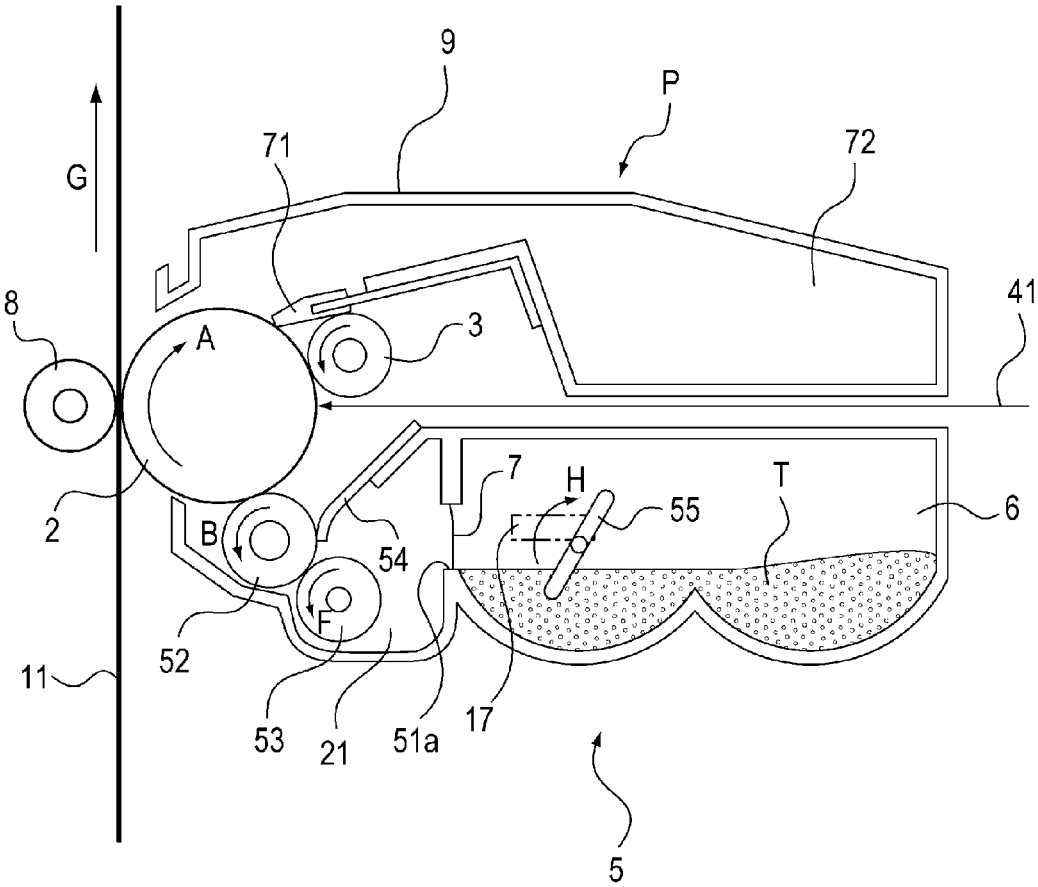
FIG. 2 is a sectional illustration showing a structure of the cartridge according to the present invention.

The developing device 5 is provided with an opening 51*a* as shown in FIG. 2, and includes a toner accommodating chamber 6 as a developer accommodating chamber for accommodating the toner T as the developer. As shown in FIG. 2, in the case where a process cartridge P is an unused one, the opening 51*a* of the toner accommodating chamber 6 is sealed with a seal member 7, as a sealing member, which includes an electroconductive portion 18 and which is configured to seal the opening 51*a*. Further, the developing device 5 includes a developing roller 52, as a developer carrying member, for supplying the developer to the surface of the electrostatic latent image formed on the surface of the photosensitive drum 2. Further, the developing device 5 includes a transfer roller 8, as a transfer device, for transferring the toner image from the surface of the photosensitive drum 2 onto the recording material 11, and includes a cleaning device 9 for removing a transfer residual toner remaining on the surface of the photosensitive drum 2 after the toner image transfer.

The toners T accommodated in the toner accommodating chambers 6 of the developing devices 5 at the image forming stations Y, M, C and K are a yellow toner TY, a magenta toner TM, a cyan toner TC and a black toner TK, respectively.

The image forming apparatus 1 in this embodiment is an example in which cartridges in the image forming stations Y, M, C and K are constituted by process cartridges PY, PM, PC and PK, respectively, detachably mountable to a main assembly of the image forming apparatus 1. Each of the process cartridges PY, PM, PC and PK is prepared by integrally assembling four process devices consisting of the photosensitive drum 2, the charging roller 3, the developing device 5 and the cleaning device 9, into a unit.

Incidentally, a developing cartridge prepared by integrally assembling at least the toner accommodating chamber 6 and the developing roller 52 with the developing device 5 may also be constituted so as to be detachably mountable to the main assembly of the image forming apparatus 1. In this embodiment, each of these process cartridges PY, PM, PC and PK and the developing cartridges is simply referred to as a cartridge. Incidentally, for convenience of explanation, there is also the case where the process cartridges PY, PM, PC and PK are simply represented by the process cartridge P. This is true for other image forming process means.

The developing device 5 includes the developing roller 52 as the developer carrying member rotating in an arrow B direction in FIG. 2 for feeding (conveying) the toner T onto the surface of the photosensitive drum 2. This developing roller 52 is a so-called elastic developing roller formed by molding an elastic member on an electroconductive core metal, and is disposed in contact with the surface of the photosensitive drum 2. Further, at a periphery of the developing roller 52, a supplying roller 53 as a supplying member rotating in an arrow F direction in FIG. 2 for supplying the non-magnetic core-component toner to the surface of the developing roller 52 is provided.

Further, a regulating blade 54 as a regulating member for giving a desired charge amount to the toner T carried on the surface of the developing roller 52 and for regulating a toner layer thickness on the surface of the developing roller 52 is provided. The toner T is accommodated in the toner accommodating chamber 6, and the opening 51*a* formed between the toner accommodating chamber 6 and the developing roller 52 so as to prevent the toner T from leaking out of the toner accommodating chamber 6 during transportation or the like is sealed with the seal member 7 when the process cartridge P is not yet used.

Figure 3:
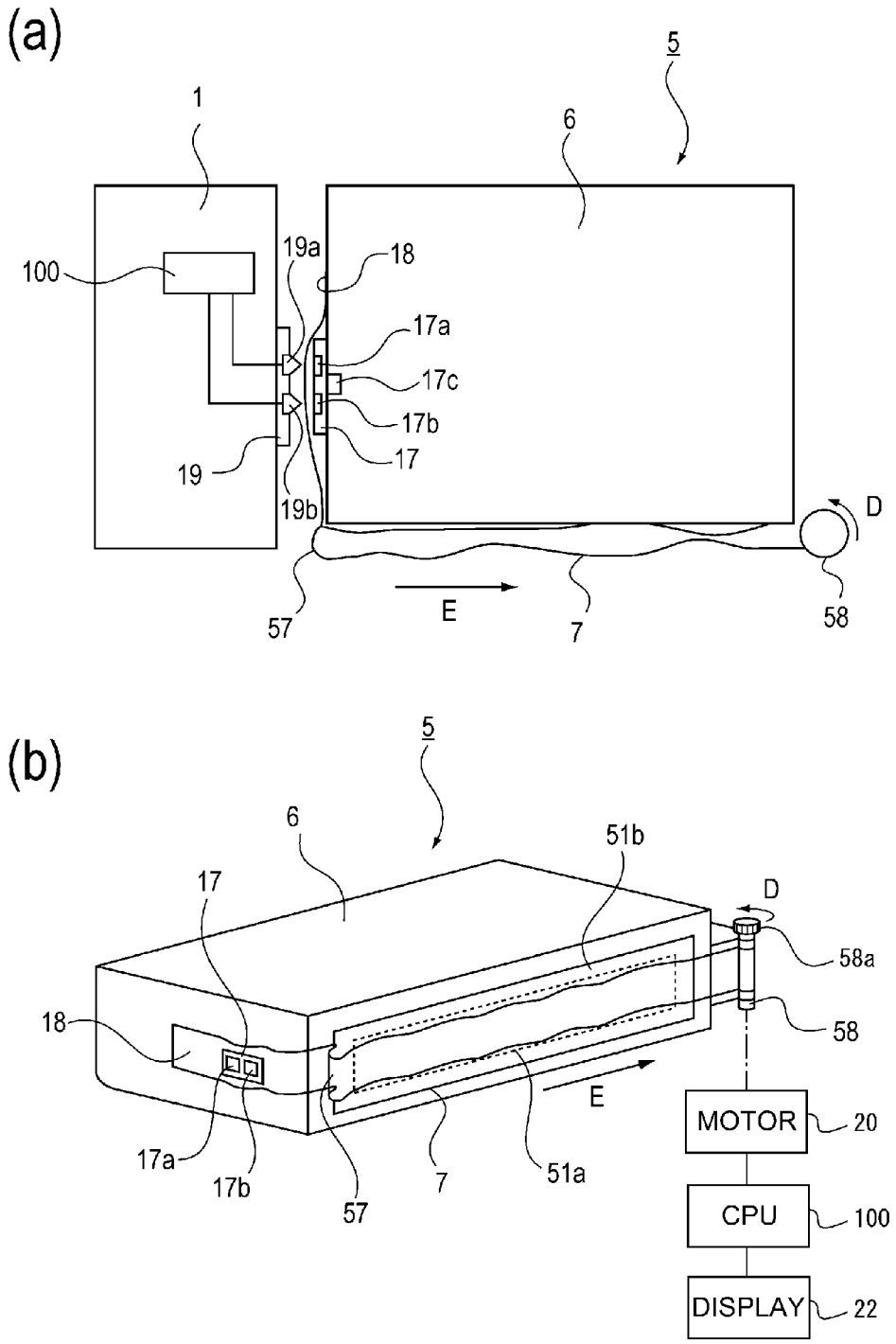
In FIG. 3, (*a*) and (*b*) are a plan view and a perspective view, respectively, showing a state in which an electroconductive portion of a sealing member covers an electrical contact provided at a surface of a storing element provided on the cartridge according to the present invention.

Further, when the process cartridge P is mounted in the main assembly of the image forming apparatus 1, the seal member 7 is removed by a winding-up member 58 as an unsealing means shown in FIG. 3. In the toner accommodating chamber 6, a stirring member 55 for supplying the toner T to the supplying roller 53 while stirring the toner T in the toner accommodating chamber 6 is rotatably provided. The supplying roller 53 is constituted by a core metal supporting shaft of metal and an elastic open-cell foam member provided on the surface of the supporting shaft.

Further, as shown in FIG. 3, on a side surface of the developing device 5, a memory 17 as a storing element for storing information on the process cartridge P is provided. The memory 17 includes a non-volatile storing portion 17*c*. On the surface of the memory 17, electrical contacts 17*a* and 17*b* are provided and exposed to an outside.

As shown in FIG. 2, the process cartridge P is mounted at a predetermined position in the main assembly of the image forming apparatus 1. Then, as shown in (a) of FIG. 3, the electrical contacts 17*a* and 17*b* of the memory 17 provided on the side surface of the developing device 5 of the process cartridge P are disposed at positions so as to oppose and be capable of supplying electric power to electrical contacts 19*a* and 19*b*, respectively, of a connector 19 provided in the main assembly of the image forming apparatus 1.

An end portion of the seal member 7 is fixed on the winding-up member 58 and the other end portion is peelably bonded to an outer peripheral edge of the opening 51*a*. To a fold-back portion 57 of the seal member 7, an electroconductive portion 18 is integrally connected.

As shown in FIG. 1, in a state in which the process cartridges P are mounted at predetermined positions in the main assembly of the image forming apparatus 1, as shown in FIG. 3, the following state is created before removal the seal member 7.

That is, the electroconductive portion 18 integrally connected to the seal member 7 is disposed so as to cover the electrical contacts 17*a* and 17*b* of the memory 17 and is peelably applied onto the side surface of the developing device 5. The electroconductive portion 18 of the seal member 7 is disposed and extended along an unsealing (removal) direction (arrow E direction in (b) of FIG. 3) of the seal member 7.

In this case, the electroconductive portion 18 contacts the electrical contacts 19*a* and 19*b* of the connector 19 to cause a short circuit between the electrical contacts 19*a* and 19*b*. In this embodiment, an example of the case where the connector 19 has the two electrical contacts 19*a* and 19*b* is described, but the connector 19 may also have three or more electrical contacts which are short-circuited by the electroconductive portion 18.

Further, as shown in FIG. 1, in the state in which the process cartridges P are mounted at the predetermined positions in the main assembly of the image forming apparatus 1, a motor 20 as a driving means provided in the image forming apparatus 1 is rotationally driven to rotate the winding-up member 58 in an arrow D direction of (b) of FIG. 3. Then, the seal member 7 is wound up and moved in the arrow E direction of FIG. 3, s that the electroconductive portion 18 is peeled off from the side surface of the developing device 5 to expose the electrical contacts 17*a* and 17*b* of the memory 17.

Then, the electrical contacts 19*a* and 19*b* of the connector 19 contact the opposing electrical contacts 17*a* and 17*b*, respectively, of the memory 17, thus being placed in an electric power supply state. In this embodiment, the electrical contacts 19*a* and 19*b* of the connector 19 are constituted with elasticity, thus being capable of being projected toward the electrical contacts 17*a* and 17*b* of the memory 17 with a predetermined elastic force.

As a result, the connector 19 provided in the image forming apparatus 1 and the memory 17 provided on the process cartridge P are communicatable with each other in a contact manner. Further, the electrical contacts 19*a* and 19*b* of the connector 19 and the electrical contacts 17*a* and 17*b* of the memory 17 are electrically conducted to each other to establish communication between the image forming apparatus 1 and the memory 17. Then, depending on information, on the process cartridge P, stored in the memory 17, a CPU 100 as a control means effects the following control. That is, image formation operation control depending on a feature of the associated process cartridge P is executed.

In FIG. 1, the photosensitive drum 2 is rotationally driven in the arrow A direction, and then is electrically charged uniformly at its surface to a negative polarity by the charging roller 3 to which a charging bias voltage is applied from an unshown charging bias power source. Thereafter, an electrostatic latent image is formed on the surface of the photosensitive drum 2 by irradiation with the laser light 41 from the laser scanner 4.

Then, the electrostatic latent image is visualized as a toner image with the toner T carried on the developing roller 52 disposed in contact with the photosensitive drum 2. Thereafter, the toner image is transferred from the surface of the photosensitive drum 2 onto the recording material 11 by a transfer roller 8, and then is melted and fixed on the recording material 11 by a fixing device 15.

The transfer residual toner remaining on the surface of the photosensitive drum 2 after the transfer of the toner image onto the recording material 11 is removed from the surface of the photosensitive drum 2 by the cleaning device 9. By repeating the above operation, the image forming operation is performed.

On each of the process cartridges PY, PM, PC and PK, the memory 17 of a contact type is mounted. Further, the electrical contacts 17*a* and 17*b* of the memory 17 contact the electrical contacts 19*a* and 19*b* of the connector 19 provided in the main assembly of the image forming apparatus 1 to realize energization, so that each cartridge P is communicatable with the CPU 100.

As shown in FIG. 1, the CPU 100 in the main assembly of the image forming apparatus 1 is connected with a host computer 200 such as a personal computer. The image forming apparatus 1 having received a print request signal from the host computer 200 controls the respective laser scanners 4 in synchronism with predetermined image formation timing, so that the electrostatic latent image is formed on each of the photosensitive drums 2. Then, the photosensitive drums 2 of the image forming stations Y, M, C and K are normally rotated and driven in the arrow A direction of FIG. 1 at a predetermined speed in synchronism with predetermined image formation timing in an image forming sequence. Then, the laser scanner 4 is driven, and at the same time, a conveyer belt 10 for electrostatically attracting and conveying the recording material 11 is rotationally driven in an arrow G direction of FIG. 1.

The conveyor belt 10 is an endless belt for electrically attracting and carrying and conveying the recording material 11. This conveyor belt 10 is provided along a vertical direction of FIG. 1 over a whole of the image forming stations Y, M, C and K in a side of the respective photosensitive drums 2, and is stretched and rotatably supported by an unshown plurality of supporting rollers. Further, at each of the image forming stations Y, M, C and K, the transfer roller 8 as a transfer means is press-contacted to the conveyor belt 10 toward the associated photosensitive drum 2. A nip between the conveyor belt 10 and each of the photosensitive drums 2 is a transfer portion.

A feeding cassette 12 as a feeding means 12 is provided at a lower portion of the main assembly of the image forming apparatus 1 shown in FIG. 1, and sheets of the recording material 11 as a recording medium (media) are stacked and accommodated therein. On the basis of the print request signal from the host computer 200, a feeding roller 13 is rotationally driven, and by a cooperation thereof with an unshown separating means, the recording material 11 is separated and fed one by one from the feeding cassette 12.

The recording material 11 fed from the feeding cassette 12 is once stopped by a registration roller pair 14. Thereafter, the registration roller pair 14 is rotationally driven in synchronism with the image formation timing of the toner image at each of the image forming stations Y, M, C and K, and then the recording material 11 is electrostatically attracted to the conveyor belt 10 and thus is gradually conveyed.

The photosensitive drum 2 of each of the image forming portion Y, M, C and K is electrically charged uniformly at its surface to a predetermined potential by applying a predetermined charging bias voltage to the charging roller 3 rotated by rotation of the photosensitive drum 2 in contact with the surface of the photosensitive drum 2 in a rotation process thereof.

In this embodiment, each photosensitive drum 2 is a rigid member constituted by successively applying a resistance layer, an undercoat laser, a photosensitive layer and a charge-transporting layer onto an outer peripheral surface of an aluminum cylinder by dip coating.

After the surface of the photosensitive drum 2 is uniformly charged by the charging roller 3, the uniformly charged surface of the photosensitive drum 2 is irradiated with the laser light 41 corresponding to each of color image signals outputted from the laser scanners 4, so that the electrostatic latent image based on image information is formed. That is, at the image forming station Y, laser exposure based on yellow image data is made, so that the electrostatic latent image is formed.

At the image forming station M, laser exposure based on magenta image data is made, so that the electrostatic latent image is formed. At the image forming station C, laser exposure based on cyan image data is made, so that the electrostatic latent image is formed. At the image forming station K, laser exposure based on black image data is made, so that the electrostatic latent image is formed. These electrostatic latent images are developed by supplying thereto the toners T of the respective colors by the developing devices 5 of the image forming stations Y, M, C and K, so that the toner images are formed.

As a result, on the surfaces of the photosensitive drums 2 of the image forming stations Y, M, C and K, a yellow toner image, a magenta toner image, a cyan toner image and a black toner image are formed, respectively, at predetermined control timing.

FIG. 2 is an enlarged sectional view of the process cartridge P. In FIG. 2, the developing device 5 accommodates the toner T of the associated color in the toner accommodating chamber 6. Further, in the developing device 5, the developing roller 52 as the developer carrying member disposed opposed to the photosensitive drum 2 for visualizing the electrostatic latent image on the surface of the photosensitive drum 2 with the toner T is provided. Further, the supplying roller 53 for supplying the toner T to the developing roller 52 is provided.

Further, the regulating blade 54 for regulating the toner layer thickness on the surface of the developing roller 52 and the stirring member 55 for feeding the toner T to the supplying roller 53 are provided.

On the developing device 5, the contact memory 17 is mounted. The electrical contacts 19*a* and 19*b* of the connector 19 provided in the main assembly of the image forming apparatus 1 and the electrical contacts 17*a* and 17*b* of the memory 17 contact to establish energization, so that the CPU 100 of the image forming apparatus 1 and the memory 17 are communicatable with each other. Before the process cartridge P is used, the opening 51*a* provided between the developing roller 52 and the toner accommodating chamber 6 is sealed by the seal member 7.

The process cartridge P including an unopened seal member 7 is mounted at a mounting position shown in FIG. 1 in the main assembly of the image forming apparatus 1. Then, as shown in FIG. 3, by the electroconductive portion 18 provided on the seal member 7, the electrical contact 19*a* and 19*b* of the connector 19 provided in the main assembly side of the image forming apparatus 1 is short-circuited. This short circuit is detected by the CPU 100 provided in the main assembly side of the image forming apparatus 1, so that the CPU 100 discriminates that the seal member 7 is in an unopened state in which the seal member 7 seals the opening 51*a*.

On the other hand, when the process cartridge P is mounted at the mounting position shown in FIG. 1 in the main assembly of the image forming apparatus 1, the gear 58*a* of the winding-up member 58 shown in FIG. 3 is engaged with a gear train connected with a rotational drive shaft of the motor 20 provided in the main assembly side of the image forming apparatus 1.

When the CPU 100 provided in the main assembly side of the image forming apparatus 1 discriminates that the seal member 7 is in the unopened state in which the seal member 7 seals the opening 51*a*, the CPU 100 controls the motor 20 to rotationally drive the winding-up member 58 provided on the developing device 5. As a result, the seal member 7 fixed at one end thereof by the winding-up member 58 is wound up and moved in the arrow E direction in FIG. 3, so that the opening 51*a* sealed by the seal member 7 is removed (exposed).

The seal member 7 is moved in the arrow E direction of FIG. 3 by being wound up. Then, also the electroconductive portion 18 provided to the seal member 7 is moved in the arrow E direction of FIG. 3, so that the electrical contacts 19*a* and 19*b* of the connector 19 provided in the main assembly side of the image forming apparatus 1 contact the electrical contacts 17*a* and 17*b* of the memory 17 provided in the developing device 5 side to establish energization. Then, the CPU 100 in the main assembly side of the image forming apparatus 1 is communicatable with the memory 17. As a result, the CPU 100 provided in the main assembly side of the image forming apparatus 1 discriminates that the seal member 7 is wound up and thus the opening 51*a* is in an unsealed (exposed) state.

When the CPU 100 discriminates that the opening 51*a* is unsealed (exposed) by winding up the seal member 7 of the developing device 5, the stirring member 55 shown in FIG. 2 is rotationally driven in the arrow H direction of FIG. 2, so that the toner T in the toner accommodating chamber 6 is fed through the opening 51*a* to the developing roller 52 in the developing chamber 21. Then, the supplying roller 53 is rotated in the arrow F direction, so that the toner is supplied to the developing roller 52.

Thereafter, with rotation of the developing roller 52 in the arrow B direction shown in FIG. 2, the toner layer thickness on the surface of the developing roller 52 is uniformly regulated by the regulating blade 54. Then, by applying a predetermined developing bias voltage to the developing roller 52, the toner T is supplied to the electrostatic latent image formed on the surface of the photosensitive drum 2 in an image forming region to develop the electrostatic latent image, so that the electrostatic latent image is visualized as the toner image.

A development residual toner, on the developing roller 52, which is not used for visualizing the electrostatic latent image at a contact portion between the photosensitive drum 2 and the developing roller 52 is returned into the developing chamber 21 of the developing device 5 by the rotation of the developing roller 52. Then, the development residual toner on the surface of the developing roller 52 is peeled off from the surface of the developing roller 52 by the supplying roller 53.

On the other hand, at predetermined control timing in FIG. 1, the recording material 11 fed from the feeding cassette 12 to the feeding belt 10 is held and conveyed in an upward direction in FIG. 1 by the conveyor belt 10. Then, in a conveying process of the recording material 11, the toner images of yellow, magenta, cyan and black formed on the surfaces of the photosensitive drums 2 at the image forming stations Y, M, C and K, respectively, are successively transferred superposedly onto the recording material 11 at the transfer portions. That is, a predetermined transfer bias voltage is applied via the conveyor belt 10 from the transfer roller 8 of each of the image forming stations Y, M, C and K, so that the toner images are successively transferred from the surfaces of the photosensitive drums 2 onto the recording material 11.

The recording material 11 on which the four-color toner images are superposedly transferred is separated from the conveyor belt 10 in an upper side of the conveyor belt 10 in FIG. 1 and then is conveyed into the fixing device 15. The fixing device 15 fixes the toner images transferred on the recording material 11 by heating and pressing the toner images. To the recording material 11 subjected to the transfer of the toner images, heat and pressure are applied when the recording material 11 passes through the fixing device 15. As a result, the toner images of the plurality of colors are permanently fixed on the surface of the recording material 11. The recording material 11 having passed through the fixing device 15 is discharged, as a full-color image-formed product based on the four colors, in a state in which an image surface thereof is directed downward, onto a discharge tray 16 provided at an upper surface of the main assembly of the image forming apparatus 1.

Further, at each of the image forming stations Y, M, C and K, the surface of the developing device 2 after the toner image is transferred onto the recording material 11 is subjected to removal of the transfer residual toner by the cleaning device 9 to prepare for subsequent image formation.

As shown in FIG. 2, the cleaning device 9 is constituted by a cleaning blade 71 as a cleaning member having flexibility (rubber elasticity) and by a residual toner accommodating portion 72 for accommodating (storing) the transfer residual toner scraped off by the cleaning blade 71. The cleaning blade 71 is disposed in contact with the photosensitive drum 2 with respect to a counter direction to a normal rotational direction shown as the arrow A direction of FIG. 2 showing the rotational direction of the photosensitive drum 2 during the image formation, and removes the toner remaining on the surface of the photosensitive drum 2 by scraping off the toner.

The process cartridge P with which the image forming operation is ended receives a subsequent print request signal from the host computer 200 such as the personal computer, and then performs a subsequent image forming operation. When there is no print request signal, the process cartridge P executes a stop control sequence of the photosensitive drum 2.

As shown in FIGS. 2 and 3, in an unused process cartridge P, the opening 51*a* of the toner accommodating chamber 6 provided in the developing device 5 is sealed by the seal member 7. The seal member 7 is formed in a sheet shape, and seals the opening 51*a* by being bonded to a wall surface of a welding surface 51*b* shown in (b) of FIG. 3 by a means such as ultrasonic welding. This seal member 7 is folded back at a fold-back portion 57 provided at an approximately intermediate portion with respect to a longitudinal direction, and is fixed on the winding-up member 58 at one longitudinal end portion thereof. The winding-up member 58 is shaft-supported rotatably by a frame of the developing device 5.

As shown in FIG. 1, the process cartridge P is mounted at the mounting position in the main assembly of the image forming apparatus 1. Then, until the seal member 7 is removed as shown in FIG. 3, the electroconductive portion 18 provided to the seal member 7 contacts the electrical contacts 19*a* and 19*b* of the connector 19 provided in the main assembly side of the image forming apparatus 1, so that the electrical contacts 19*a* and 19*b* is short-circuited.

Then, the seal member 7 is removed, the electroconductive portion 18 causing the short circuit between the electrical contacts 19*a* and 19*b* of the connector 19 in contact with the electrical contacts 19*a* and 19*b* is removed. Then, the electrical contacts 17*a* and 17*b* of the non-volatile memory 17 and the electrical contacts 19*a* and 19*b* of the connector 19 provided in the main assembly side of the image forming apparatus 1 contact each other to establish energization therebetween, so that communication is made between the memory 17 and the CPU 100.

When the electrical contacts 19*a* and 19*b* of the connector 19 is detected as being in a floating state, the CPU 100 discriminates that the process cartridge P is in a state in which the process cartridge P is not mounted at the mounting position in the main assembly of the image forming apparatus 1 shown in FIG. 1.

Further, the short circuit of the electrical contacts 19*a* and 19*b* of the connector 19 is detected. Then, the CPU 100 discriminates that although the process cartridge P is mounted at the mounting position in the main assembly of the image forming apparatus 1 shown in FIG. 1, the seal member 7 is not yet wound up and seals the opening 51*a* of the toner accommodating chamber 6.

Then, the CPU 100 drive-controls the motor 20 as the driving means shown in (b) of FIG. 3 to rotate the winding-up member 58 in the arrow D direction of (b) of FIG. 3, so that the seal member 7 is wound up to unseal (expose) the opening 51*a* of the toner accommodating chamber 6.

In this case, also the electroconductive portion 18 provided to the seal member 7 is moved in the arrow E direction of FIG. 3 to eliminate the short circuit between the electrical contacts 19*a* and 19*b* of the connector 19. Then, the electrical contacts 19*a* and 19*b* of the connector 19 and the electrical contacts 17*a* and 17*b* of the memory 17 are contacted to each other, thus being electrically conducted to each other.

When enabling of the communication between the CPU 100 and the memory 17 is detected, the CPU 100 discriminates that the process cartridge P is in the mounted state at the mounting position in the main assembly of the image forming apparatus 1 shown in FIG. 1 and that the seal member 7 is wound up to unseal (expose) the opening 51*a* of the toner accommodating chamber 6.

In the case where the plurality of process cartridges P are mounted in the main assembly of the image forming apparatus 1, the non-volatile memory 17 provided in each of the process cartridges P and the CPU 100 of the main assembly of the image forming apparatus 1 make communication of a contact type. Then, a removing operation of the seal member 7 is executed for a removing operation time of the seal member 7 of the process cartridge P, of the plurality of process cartridges P mounted in the main assembly of the image forming apparatus 1, requiring a longest removing operation time.

COMPARISON EXAMPLE

For example, as Comparison Example of detection of the removal of the seal member 7, an image for detection is printed on the conveyor belt 10 by a predetermined process cartridge P. Then, a toner density (concentration) of the image for detection is detected by an unshown toner density detection sensor for detecting the toner density on the outer peripheral surface of the conveyor belt 10. A detection result thereof is received by the CPU 100, and then the CPU 100 discriminates the presence or absence of the image for detection. In the case where the image for detection is present, the CPU 100 can discriminate that the seal member 7 is detected, and in the case where the image for detection is absent, the CPU 100 can discriminate that the seal member 7 is not removed.

However, in recent years, the efforts toward achieving environmental protection have been made actively, and as a part thereof, reductions of the parts (components) and the size and the like are made. For that reason, it has been desired that a performance comparable to or more than a conventional performance is satisfied by a constitution simpler than a conventional constitution.

For example, JP-A 2005-189528 has proposed a constitution in which communication of a non-contact memory, provided on a process cartridge, with the main assembly of the image forming apparatus 1 is inhibited by using the seal member 7 sealing the opening 51*a* of the toner accommodating chamber 6 of the photosensitive drum 5 for the purpose of simply carrying out detection of the removal of the seal member. In the constitution, the non-contact memory is provided on the process cartridge P, and a communication inhibiting member for inhibiting non-contact communication between the non-contact memory and a memory communication portion provided in the image forming apparatus 1.

The communication inhibiting member is connected with the seal member sealing the toner T. Therefore, in the case where the seal member is removed, also the communication inhibiting member is removed, so that the communication can be established between the non-contact memory and the memory communication portion of the image forming apparatus 1. By this method, when the communication between the non-contact memory and the image forming apparatus 1 is normally established, it is possible to detect that the seal member is removed.

On the other hand, in the case where the seal member is not removed, the communication inhibiting member is present between the non-contact memory and the memory communication portion of the image forming apparatus 1, and therefore the non-contact memory and the image forming apparatus cannot communicate with each other. That is, in the case where the communication cannot be established between the non-contact memory and the image forming apparatus, it is possible to detect that the seal member is not removed. In this method, by discriminating enabling or disabling of the communication between the image forming apparatus 1 and the non-contact memory, detection of removal of the seal member sealing the toner 1 is intended to be carried out.

However, in this method, in the case where the non-contact memory is broken or lost, the communication between the non-contact memory and the image forming apparatus 1 was not normally made, and thus the seal member was erroneously detected as being not removed in some cases.

On the other hand, in this embodiment, the process cartridge P is provided with the contact memory 17. The constitution in which the electroconductive portion 18 of the seal member 7 was interposed between the electrical contacts 17*a* and 17*b* of this memory 17 and the electrical contacts 19*a* and 19*b* of the connector 19 provided at a communication portion of the image forming apparatus 1 where the image forming apparatus 1 communicated with the memory 17 in the contact manner was employed. As a result, in the embodiment of the present invention, it is possible to detect the removal of the seal member 7 sealing the toner T (opening 51*a*) without being adversely affected by the breakage or the loss of the memory 17 provided on the process cartridge P.

That is, even when the memory is broken or lost, the floating state of the electrical contacts 19*a* and 19*b* of the connector 19 provided in the main assembly side of the image forming apparatus 1 is detected. Then, the CPU 100 can discriminate that the process cartridge P is in the state in which the process cartridge P is not mounted at the mounting position in the main assembly of the image forming apparatus 1 shown in FIG. 1.

Further, the short circuit between the electrical contacts 19*a* and 19*b* of the connector 19 is detected. Then, the CPU 100 discriminates that although the process cartridge P is mounted at the mounting position in the main assembly of the image forming apparatus 1 shown in FIG. 1, the seal member 7 is not yet wound up. As a result, it is possible to discriminate that the opening 51*a* of the toner accommodating chamber 6 is still sealed with the seal member 7. Then, the CPU 100 drive-controls the motor 20 as the driving means shown in (b) of FIG. 3 to rotate the winding-up member 58 in the arrow D direction of FIG. 3, so that the seal member 7 is wound up to unseal (expose) the opening 51*a* of the toner accommodating chamber 6.

Further, in this embodiment, the discrimination can be made even in the case where the communication cannot be made between the CPU 100 and the memory 17 due to the breakage or less of the memory 17. For example, the CPU 100 is provided with a timer, so that it is possible to detect the state of the electrical contacts 19*a* and 19*b* of the connector 19 in a time-series manner such that the state is changed from the floating state to the short-circuited state and then is changed again to the floating state.

At that time, the CPU 100 discriminates that the process cartridge P is in the mounted state at the mounting position in the main assembly of the image forming apparatus 1 shown in FIG. 1 and that the seal member 7 is wound up and thus the opening 51*a* of the toner accommodating chamber 6 is unsealed or exposed. Alternatively, the CPU 100 can discriminate that the process cartridge P is demounted from the main assembly of the image forming apparatus 1.

Incidentally, a detecting means for detecting the mounting of the process cartridge P in the main assembly of the image forming apparatus 1 is separately provided. Then, by making reference to a detection result of the detecting means, it is possible to discriminate that in the mounted state at the mounting position in the main assembly of the image forming apparatus 1 shown in FIG. 1, the seal member 7 is wound up and thus the opening 51*a* of the toner accommodating chamber 6 is unsealed or exposed. Alternatively, it is possible to discriminate that the process cartridge P is demounted from the main assembly of the image forming apparatus 1.

<Detection of Presence or Absence of Process Cartridge>

As shown in FIG. 3, the developing device 5 is provided with the contact memory 17, and the image forming apparatus 1 is provided with the connector 19 for communicating with the contact memory 17. The memory 17 is provided with the electrical contacts 17*a* and 17*b*, and communicates with the CPU 100 by bring the electrical contacts 17*a* and 17*b* into contact with the electrical contacts 19*a* and 19*b*, respectively, provided on the connector 19.

In the case where the unopened process cartridge P is mounted in the main assembly of the image forming apparatus 1, the electroconductive portion 18 of the seal member 7 is interposed between the electrical contact 17*a* or 17*b* of the memory 17 and the electrical contact 19*a* or 19*b* of the connector 19. Thus, the electrical contacts 19*a* and 19*b* of the connector 19 contact the electroconductive portion 18 and are placed in the short-circuited state.

In the case where the short-circuited state between the electrical contacts 19*a* and 19*b* of the connector 19 is detected, the CPU 100 of the image forming apparatus 1 discriminates that the electrical contacts 19*a* and 19*b* contact the electroconductive portion 18 provided integrally with the seal member 7. As a result, the CPU 100 discriminates that the process cartridge P is mounted in the image forming apparatus 1.

In this way, in this embodiment, the detection of the presence or absence of the process cartridge P is made depending on whether or not the electrical contacts 19*a* and 19*b* of the connector 19 are in the short-circuited state. For this reason, in the unused process cartridge P, even in the case where the memory 17 is broken or lost, the detection of the presence or absence of the process cartridge P can be easily made.

<Detection of Removal of Sealing Member>

As shown in FIG. 3, the electroconductive portion 18 is connected with the seal member 7 sealing the opening 51*a* of the toner accommodating chamber 6 at the fold-back portion 57 provided at the intermediate portion of the seal member 7 with respect to the longitudinal direction. Therefore, in the case where the seal member 7 is unopened, the electroconductive portion 18 is present between the electrical contact 17*a* or 17*b* of the memory 17 and the electrical contact 19*a* or 19*b* of the connector 19, so that the electrical contacts 19*a* and 19*b* of the connector 19 are placed in the short-circuited state.

In the case where the CPU 100 discriminates that the electrical contacts 19*a* and 19*b* of the connector 19 are detected as being in the short-circuited state, the CPU 100 discriminates that the seal member 7 is unopened. On the other hand, in the case where the electrical contacts 19*a* and 19*b* of the connector 19 are not in the short-circuited state, the CPU 100 discriminates that the electroconductive portion 18 is removed from between the electrical contact 17*a* or 17*b* of the memory 17 and the electrical contact 19*a* or 19*b* of the connector 19. At the same time, the CPU 100 discriminates that the opening 51*a* sealed by the seal member 7 is unsealed or exposed.

In this way, in this embodiment, depending on whether or not the short-circuited state is created between the electrical contacts 19*a* and 19*b* of the connector 19, detection of removal of the seal member 7 is made. For this reason, even in the case where the memory 17 is broken or lost, it is possible to detect the removal of the seal member 7.

Figure 4:
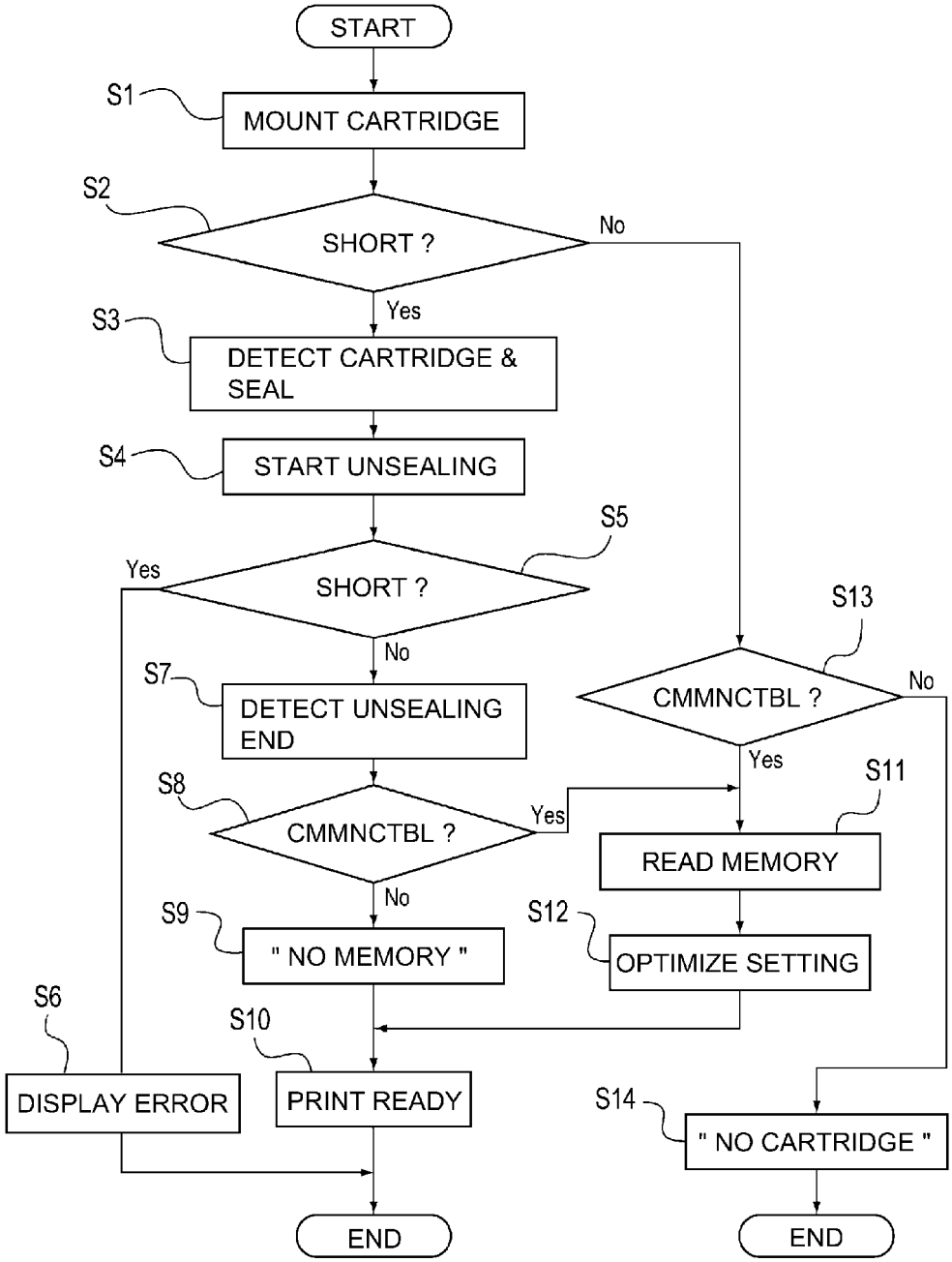
FIG. 4 is a flowchart showing a state in which presence/absence detection of the cartridge according to the present invention and removal detection of a sealing member are executed.

Next, with reference to FIG. 4, the detection of the presence or absence of the process cartridge P and control of detection of the removal of the seal member 7 in this embodiment will be described. In step S1 of FIG. 4, when the process cartridge P is mounted in the main assembly of the image forming apparatus 1, when the process cartridge P is mounted in the main assembly of the image forming apparatus 1, in step S2, the CPU 100 discriminates as to whether or not the short-circuited state is created between the electrical contacts 19*a* and 19*b* of the connector. In step S2, in the case where the CPU 100 discriminates that the short-circuited state is created between the electrical contacts 19*a* and 19*b* of the connector 19, a sequence goes to step S3. In step S3, the CPU 100 discriminates that the process cartridge P is mounted in the main assembly of the image forming apparatus 1 and that the seal member 7 is not yet removed.

Next, in step S4, the CPU 100 controls the motor 20 to rotationally drive the winding-up member 58 in the arrow D direction of FIG. 3, so that the seal member 7 is wound up to unseal (expose) the opening 51*a* of the toner accommodating chamber 6 of the developing device 5.

In this case, also the electroconductive portion 18 causing the short circuit between the electrical contacts 19*a* and 19*b* of the connector 19 is moved in the arrow E direction of FIG. 3 by being integrally wound up with the seal member 7 to be removed from between the electrical contacts 19*a* and 19*b* of the connector 19. Then, the electrical contacts 19*a* and 19*b* of the connector 19 and contacted and electrically conducted to the electrical contacts 17*a* and 17*b* of the memory 17, so that the communication between the CPU 100 and the memory 17 can be made.

Therefore, in step S5, the CPU 100 discriminates again as to whether or not the short-circuited state is created between the electrical contacts 19*a* and 19*b* of the connector. In step S5, in the case where the CPU 100 discriminates that the short-circuited state is created between the electrical contacts 19*a* and 19*b* of the connector 19, the seal member 7 is not normally removed, and therefore the sequence goes to step S6. In step S6, the CPU 100 causes a display portion 22 as a display means to display an error message to notify a use of the error, and then ends the sequence.

In the case where in step S5, the CPU 100 discriminates that the short-circuited state is not created between the electrical contacts 19*a* and 19*b* of the connector 19, the sequence goes to step S7, in which the CPU 100 discriminates that the seal member 7 is normally removed. Then, in step S8, whether or not the memory 17 in the process cartridge P side and the CPU 100 in the main assembly side of the image forming apparatus 1 are communicatable with each other is discriminated.

In the case where the CPU 100 and the memory 17 are communicatable with each other, the sequence goes to step S11, and the CPU 100 reads information, on the process cartridge P, stored in the memory 17. Then, in step S12, the CPU 100 optimizes setting of the process cartridge P. Thereafter, the sequence goes to step S10, in which the image forming apparatus 1 is placed in a print-ready state, and then the sequence is ended.

In the above step S8, in the case where the communication cannot be made between the CPU 100 in the main assembly side of the image forming apparatus 1 and the memory 17 in the process cartridge P side, the sequence, goes to step S9. In step S9, the CPU 100 discriminates that the memory 17 is broken or lost, and causes the display portion 22 to display a message of "NO MEMORY". Then, the sequence goes to step S10, in which the image forming apparatus 1 is placed in the print-ready state, and then the sequence is ended.

In the step S2, in the case where the short-circuited state is not created between the electrical contacts 19*a* and 19*b* of the connector 19, the sequence goes to step S13, in which whether or not the communication can be made between the CPU 100 in the main assembly side of the image forming apparatus 1 and the memory 17 in the process cartridge P side is discriminated. In the case where the communication is disabled between the CPU 100 and the memory 17, the sequence goes to step S14, in which the CPU 100 discriminates that the process cartridge P is not mounted in the main assembly of the image forming apparatus 1 and causes the display portion 22 to display a message of "NO PROCESS CARTRIDGE", and then the sequence is ended.

In the above step S13, in the case where the memory 17 in the process cartridge P side and the CPU 100 in the main assembly side of the image forming apparatus 1 are communicatable with each other, the sequence goes to the step S11. In the step S11, the CPU 100 reads information, on the process cartridge P, stored in the memory 17. Then, in step S12, the CPU 100 optimizes setting of the process cartridge P. Thereafter, the sequence goes to step the S10, in which the image forming apparatus 1 is placed in a print-ready state, and then the sequence is ended.

By employing such a constitution, it is possible to detect the removal of the seal member 7 sealing the toner T without being adversely affected by the breakage or loss of the memory 17 provided on the process cartridge P. Further, it is possible to detect whether or not the unused process cartridge P is mounted in the main assembly of the image forming apparatus 1.

In the constitution of JP-A 2005-189528, whether or not the communication between the non-contact memory and the memory communication portion of the image forming apparatus was enable was discriminated, so that whether or not the seal member was removed was detected.

For this reason, in the case where the non-contact memory is broken or lost, the communication between the non-contact memory and the image forming apparatus 1 was not normally made, and thus the seal member was erroneously detected as being not removed in some cases although the seal member had already been removed.

In this embodiment, it is possible to detect the removal of the seal member 7 sealing the toner T without being adversely affected by the breakage or less of the memory 17 provided on the process cartridge P, i.e., irrespective of the communication between the memory 17 and the CPU 100 of the image forming apparatus 1. Further, it is possible to detect whether or not the process cartridge P is mounted in the main assembly of the image forming apparatus 1.

Incidentally, in this embodiment, the constitution in which the electroconductive portion 18 and the seal member 7 are connected with each other is employed, but in place of the electroconductive portion 18, the seal member 7 constituted by an electroconductive member may also be used. Further, the electroconductive portion may also be provided only at a part of the surface (in the side facing the electrical contacts 19*a* and 19*b* of the connector 19) opposite from the electrical contacts 17*a* and 17*b* of the memory 17 of the seal member 7.

Further, in this embodiment, a contact developing type in which the photosensitive drum 2 and the developing roller 52 contact each other is employed, but the present invention is not limited to the contact developing type. The present invention is also effective in an image forming type using a non-magnetic jumping developing type or the like using a toner supplying roller.

Further, in this embodiment, the four-color based full-color image forming apparatus having the vertical tandem constitution (in-line constitution) is described, but the present invention is not limited to the vertical tandem constitution. The present invention is also effective in also an image forming apparatus having a horizontal tandem constitution or a rotary constitution.

According to the above-described constitutions, when the sealing member sealing the opening of the toner accommodating chamber is removed, also the electroconductive portion covering the electrical contacts provided on the surface of the storing element is removed. Then, the electrical contacts of the storing element are communicatable with the electrical contacts in the main assembly side of the image forming apparatus, so that the removal of the sealing member can be detected in the main assembly side of the image forming apparatus. Further, it is possible to detect that the cartridge is normally mounted in the main assembly of the image forming apparatus.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 108521/2013 filed May 23, 2013, which is hereby incorporated by reference.

What is claimed is:

1. A cartridge comprising:

a developer accommodating chamber, provided with an opening, for accommodating a developer;

a sealing member, provided with an electroconductive portion, for sealing the opening; and a storing element, provided with an electrical contact at a surface thereof, for storing information on said cartridge, wherein the electroconductive portion covers the electrical contact.

2. A cartridge according to claim 1, wherein said sealing member is an electroconductive member.

3. A cartridge according to claim 1, wherein the electroconductive portion is provided at a part of a surface of said sealing member in a side opposite from the electrical contact of said storing element.

4. A cartridge according to claim 1, wherein the electroconductive portion of said sealing member is extended along an unsealing direction of said sealing member.

5. A cartridge according to claim 1, wherein said storing element includes a non-volatile storing portion.

6. A cartridge according to claim 1, wherein a connector communicatable with said storing element is provided in an image forming apparatus, and wherein said storing element and the connector establish communication of a contact type.

7. A cartridge according to claim 6, wherein the connector includes at least two electrical contacts, and wherein the electrical contacts of the connector are short-circuited by contact with the electroconductive portion.

8. A cartridge according to claim 1, further comprising unsealing means for removing said sealing member.

9. A developing cartridge comprising:

a cartridge according to claim 1; and a developer carrying member for supplying a developer to a surface of an electrostatic latent image.

10. An image forming apparatus for forming an image on a recording material, comprising:

a developing cartridge according to claim 9 detachably mountable to said image forming apparatus.

11. A process cartridge comprising:

a cartridge according to claim 1; and an image bearing member on which a developer image is formed by a developer.

12. A cartridge comprising:

a developer accommodating chamber, provided with an opening, for accommodating a developer;

a sealing member, provided with an electroconductive portion, for sealing the opening; and a storing element, provided with an electrical contact capable of supplying electric power to an electrical contact of a connector provided in an image forming apparatus, for storing information on said cartridge and communicatable with the connector, wherein the electroconductive portion contacts the electrical contact of the connector.

* * * * *